US012318049B2

(12) United States Patent
Craft, II

(10) Patent No.: US 12,318,049 B2
(45) **Date of Patent: *Jun. 3, 2025**

(54) SHOWER SEAT ASSEMBLY

(71) Applicant: COMPONENT SOURCING INTERNATIONAL, LLC, Charlotte, NC (US)

(72) Inventor: Steven Gregory Craft, II, Waxhaw, NC (US)

(73) Assignee: Component Sourcing International, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/373,103

(22) Filed: Sep. 26, 2023

(65) Prior Publication Data

US 2024/0023761 A1 Jan. 25, 2024

Related U.S. Application Data

(62) Division of application No. 17/855,161, filed on Jun. 30, 2022, now Pat. No. 11,800,956.

(51) Int. Cl.
*A47K 3/28* (2006.01)

(52) U.S. Cl.
CPC ..... *A47K 3/282* (2013.01)

(58) Field of Classification Search
CPC ..... A47K 3/282
USPC ..... 4/611
See application file for complete search history.

(56) References Cited

U.S. PATENT DOCUMENTS

| | | | | |
|---|---|---|---|---|
| 6,807,690 | B1 * | 10/2004 | Satterfield | A47K 3/282 297/14 |
| 9,844,272 | B1 * | 12/2017 | Vetter | A47C 9/06 |
| 10,463,158 | B2 * | 11/2019 | Lin | A47C 9/06 |
| 11,678,773 | B2 * | 6/2023 | Robertson | A47K 3/282 4/218 |
| 11,800,956 | B1 * | 10/2023 | Craft | A47K 3/282 |
| 2021/0307519 | A1 * | 10/2021 | Masiero | A47K 3/282 |

* cited by examiner

*Primary Examiner* — Huyen D Le
(74) *Attorney, Agent, or Firm* — Blake E. Vande Garde; AVEK IP, LLC.

(57) ABSTRACT

A shower seat assembly comprising a first mounting bracket with a front side and a back side, a second mounting bracket with a front side and a back side, a first support rod hingedly connected to the first mounting bracket, a first tube stop secured to the first mounting bracket, a second support rod hingedly connected to the second mounting bracket, a second tube stop secured to the second mounting bracket, a first spring operationally associated with the first mounting bracket and the first support rod, a second spring operationally associated with the second mounting bracket and the second support rod, and a seat with an upper surface and a lower surface secured by its lower surface to the first support rod and the second support rod; wherein the back side of the first mounting bracket and second mounting bracket are each engaged to a vertical or near vertical surface.

16 Claims, 14 Drawing Sheets

SHOWER SEAT ASSEMBLY

RELATED CASES

This is a divisional application of U.S. patent application Ser. No. 17/855,161 filed on Jun. 30, 2022. The full disclosure of this application is expressly incorporated herein by reference.

FIELD OF INVENTION

The present invention relates to shower seats and more particularly to a lift-assist shower seat assembly which is designed to be secured to a wall or other structure within a shower or bath enclosure to allow an individual to sit while showering and/or bathing.

BACKGROUND OF THE INVENTION

For the physically impaired and the elderly, standing unaided in a shower can be a daunting task. While these individuals want to maintain their independence, potential injury from fatigue or unsteadiness in a bathing environment is something that no one should underestimate or ignore. Falls which occur while bathing have a high likelihood of injury which may lead to hospital stays, loss of independence, and even a need to move to an assisted living facility.

Shower chairs can provide much needed stability for individuals in the shower. Shower chairs provide a user with a comfortable resting place while they shower, which can prevent slips and falls. Shower seat designs which require a user to lift and place a free-standing shower chair onto the floor of a shower or bath enclosure can be heavy, cumbersome, awkward, and even dangerous. These designs also add to the clutter in a bathing environment, creating both an issue with where to store the device when it is not in use, and an issue with an additional tripping hazard.

Accordingly, there is clearly a need for an improved shower seat assembly for allowing an individual to sit while showering and/or bathing, while also being easy to operate and store conveniently.

SUMMARY OF THE INVENTION

A shower seat assembly comprising a first mounting bracket with a front side and a back side, a second mounting bracket with a front side and a back side, a first support rod hingedly connected to the first mounting bracket, a first tube stop secured to the first mounting bracket, a second support rod hingedly connected to the second mounting bracket, a second tube stop secured to the second mounting bracket, a first spring operationally associated with the first mounting bracket and the first support rod, a second spring operationally associated with the second mounting bracket and the second support rod, and a seat with an upper surface and a lower surface secured by its lower surface to the first support rod and the second support rod; wherein the back side of the first mounting bracket and second mounting bracket are each engaged to a vertical or near vertical surface.

DETAILED DESCRIPTION

Figure 1:
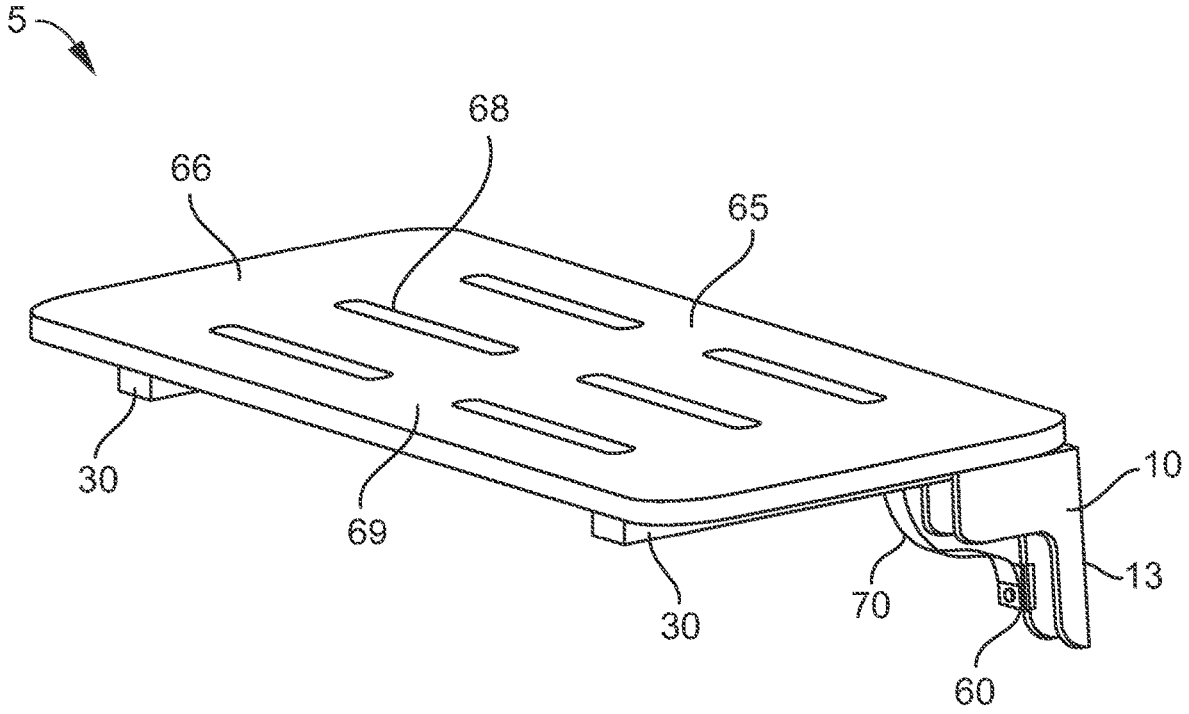
FIG. 1 is a perspective view of an embodiment of a shower seat assembly of the instant invention.
Figure 2:
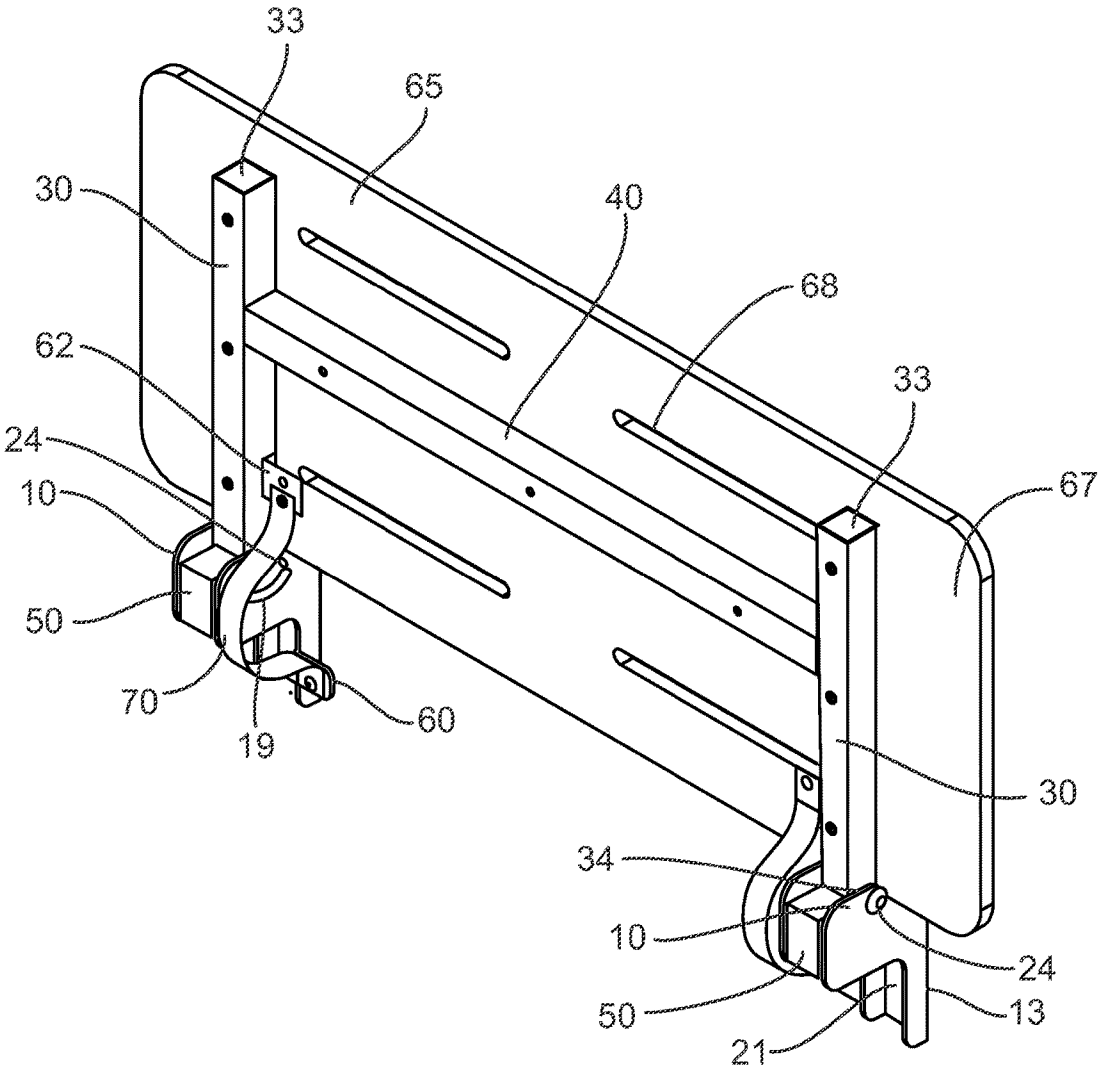
FIG. 2 is a perspective view of an embodiment of a shower seat assembly of the instant invention.
Figure 3:
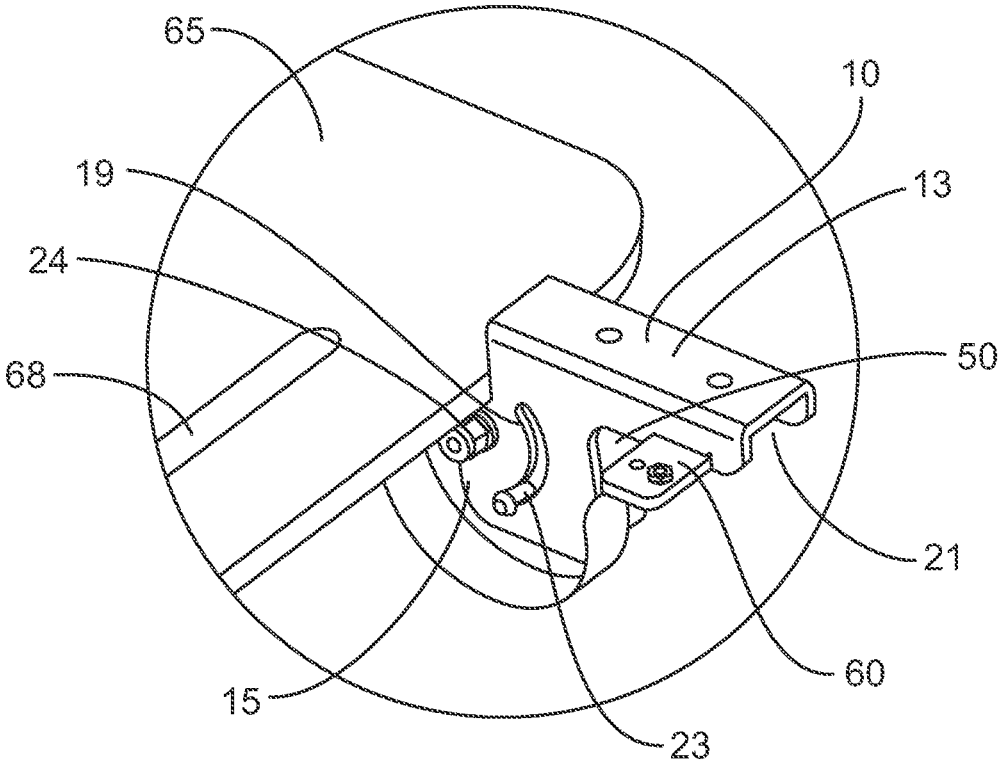
FIG. 3 is a zoomed in perspective view of an embodiment of a mounting bracket of the instant invention.
Figure 4:
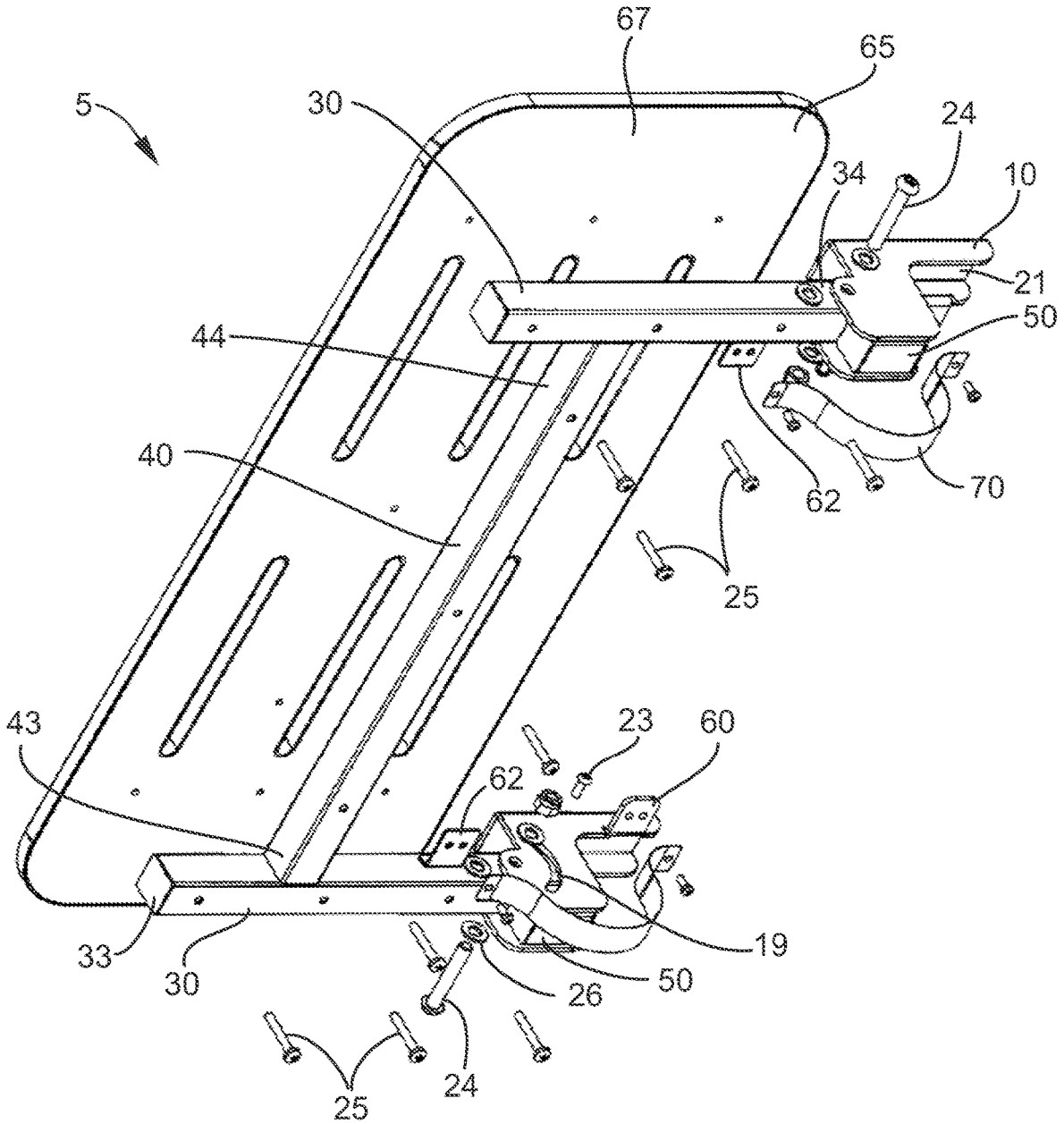
FIG. 4 is an exploded underside perspective view of an embodiment of a shower seat assembly of the instant invention.
Figure 5A:
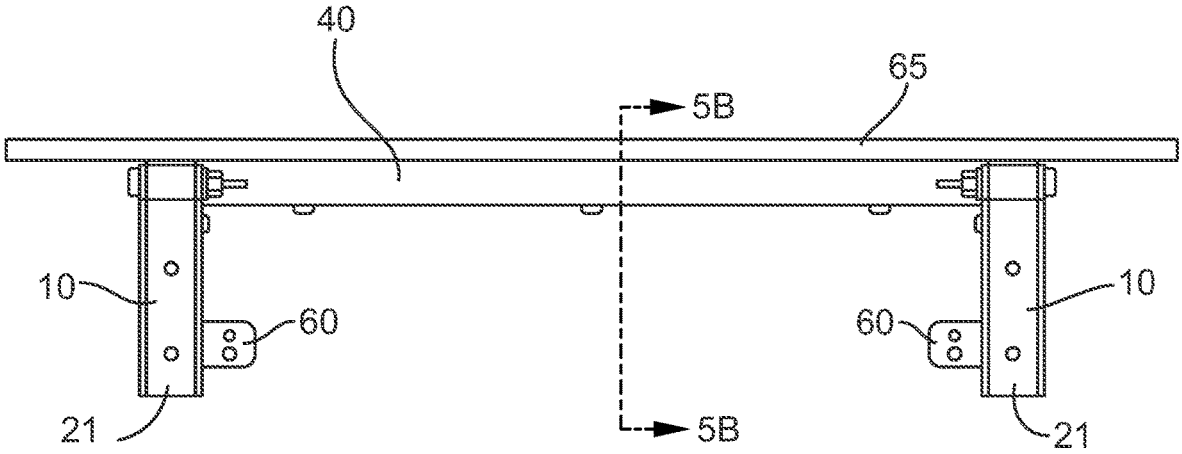
FIG. 5A is a rear view of an embodiment of a shower seat assembly of the instant invention.
Figure 5B:
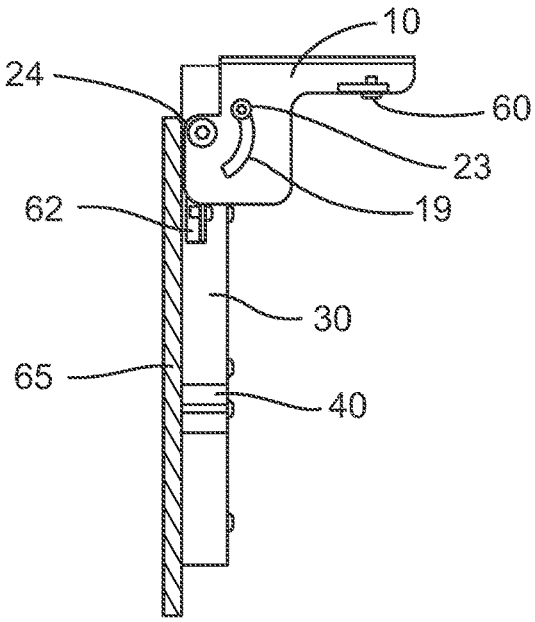
FIG. 5B a cross-sectional view of an embodiment of a shower seat assembly of the instant invention taken along the 5B-5B line from FIG. 5A.
Figure 6:
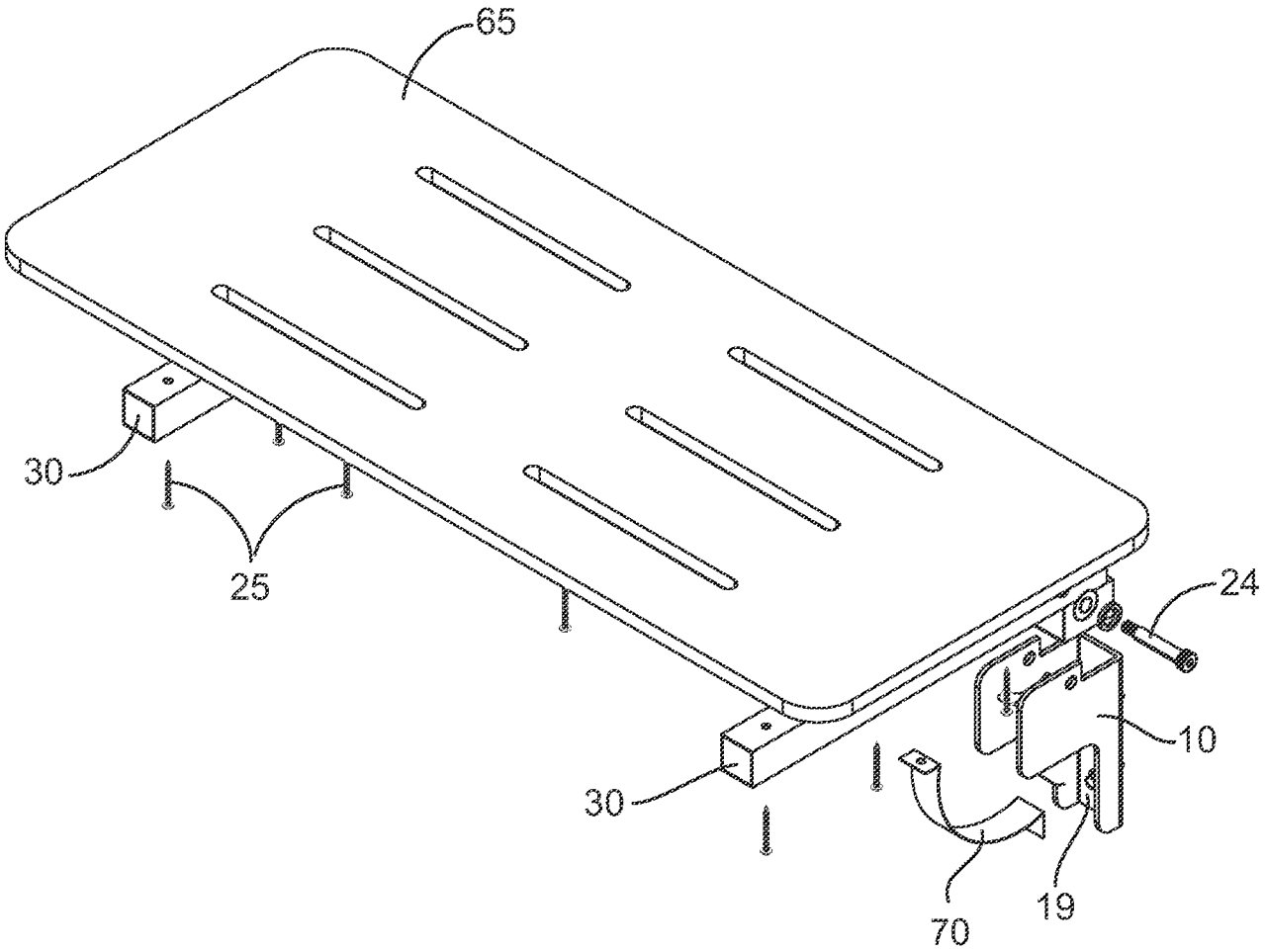
FIG. 6 is an exploded topside perspective view of an embodiment of a shower seat assembly of the instant invention.
Figure 7A:
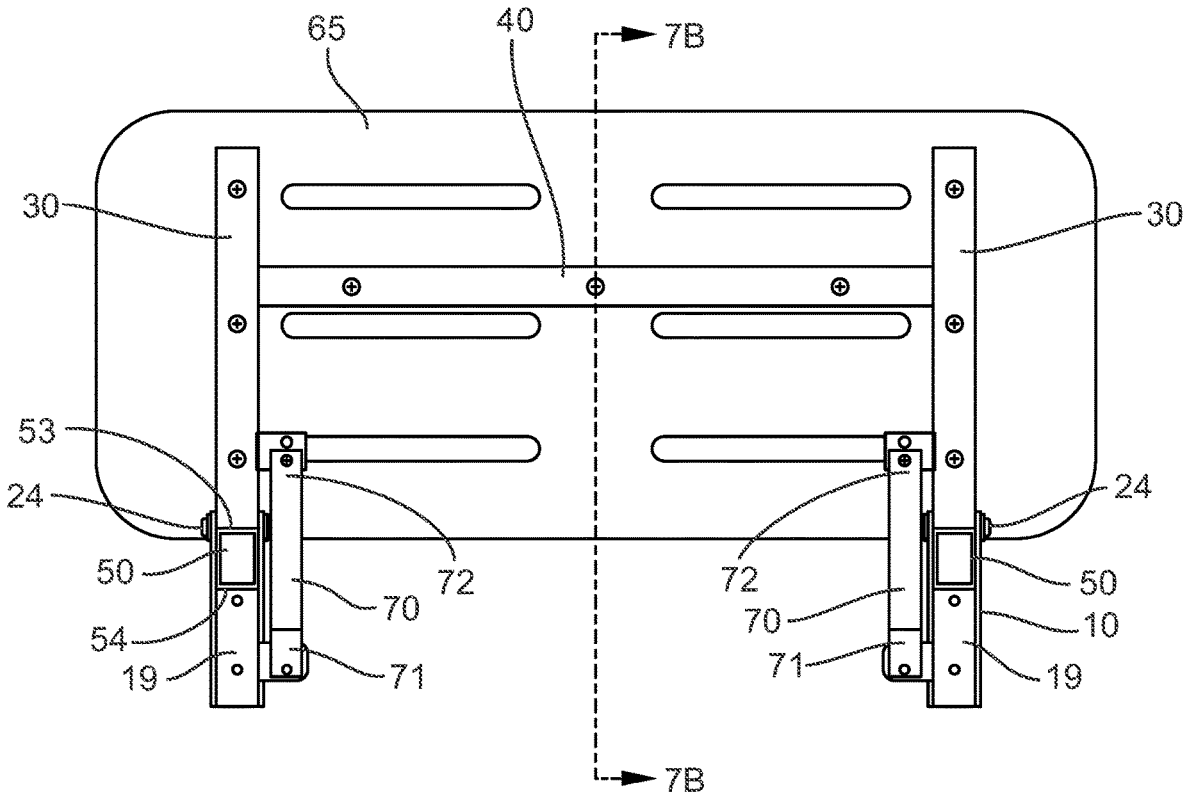
FIG. 7A is a front view of an embodiment of a shower seat assembly of the instant invention in a raised position.
Figure 7B:
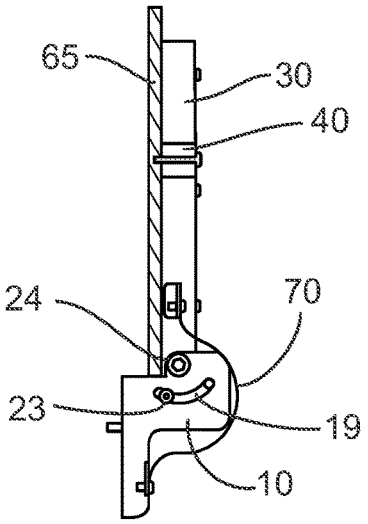
FIG. 7B a cross-sectional view of an embodiment of a shower seat assembly of the instant invention taken along the 7B-7B line from FIG. 7A.
Figure 8:
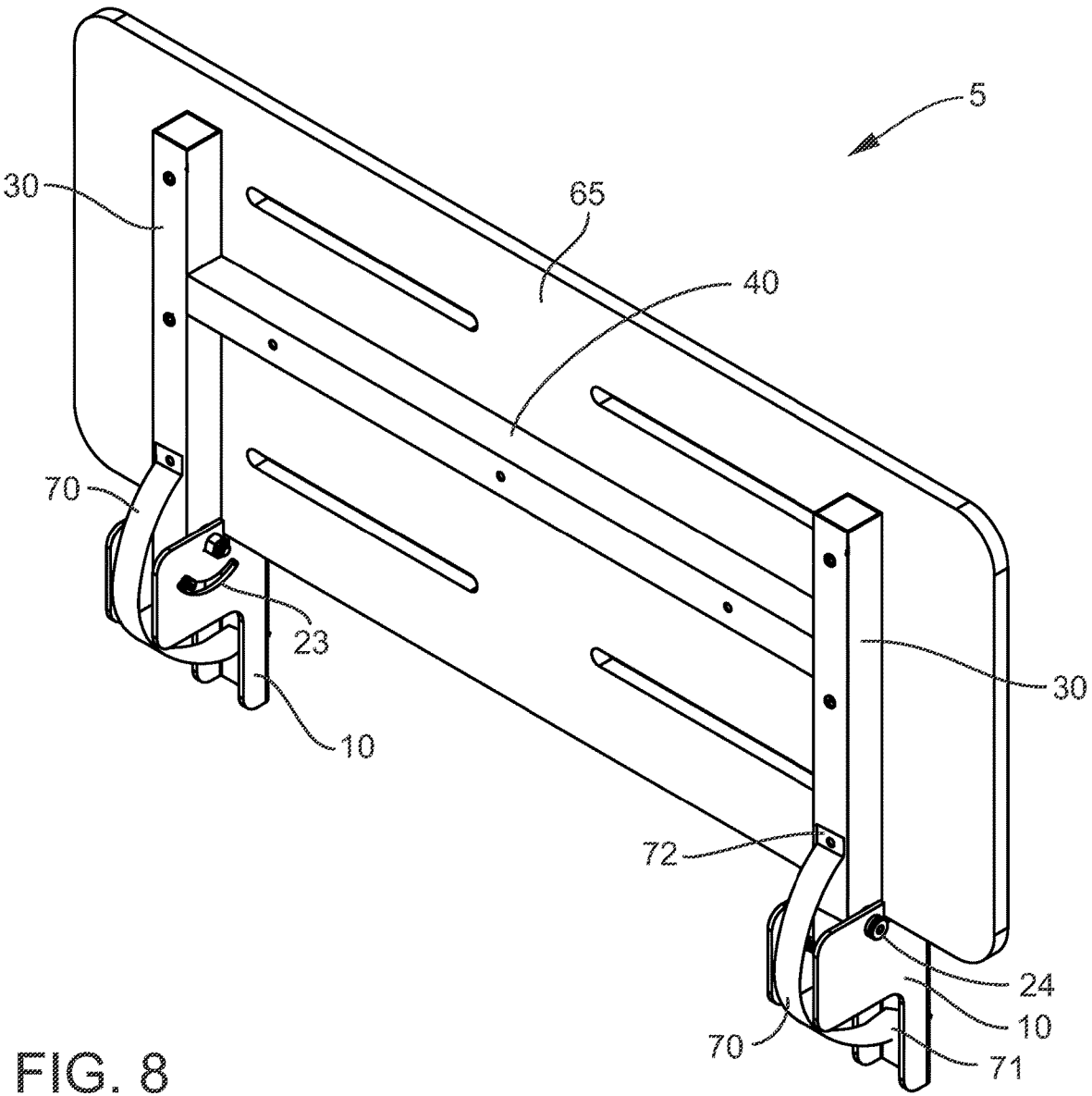
FIG. 8 is a perspective view of an embodiment of a shower seat assembly of the instant invention in a raised position.
Figure 9A:
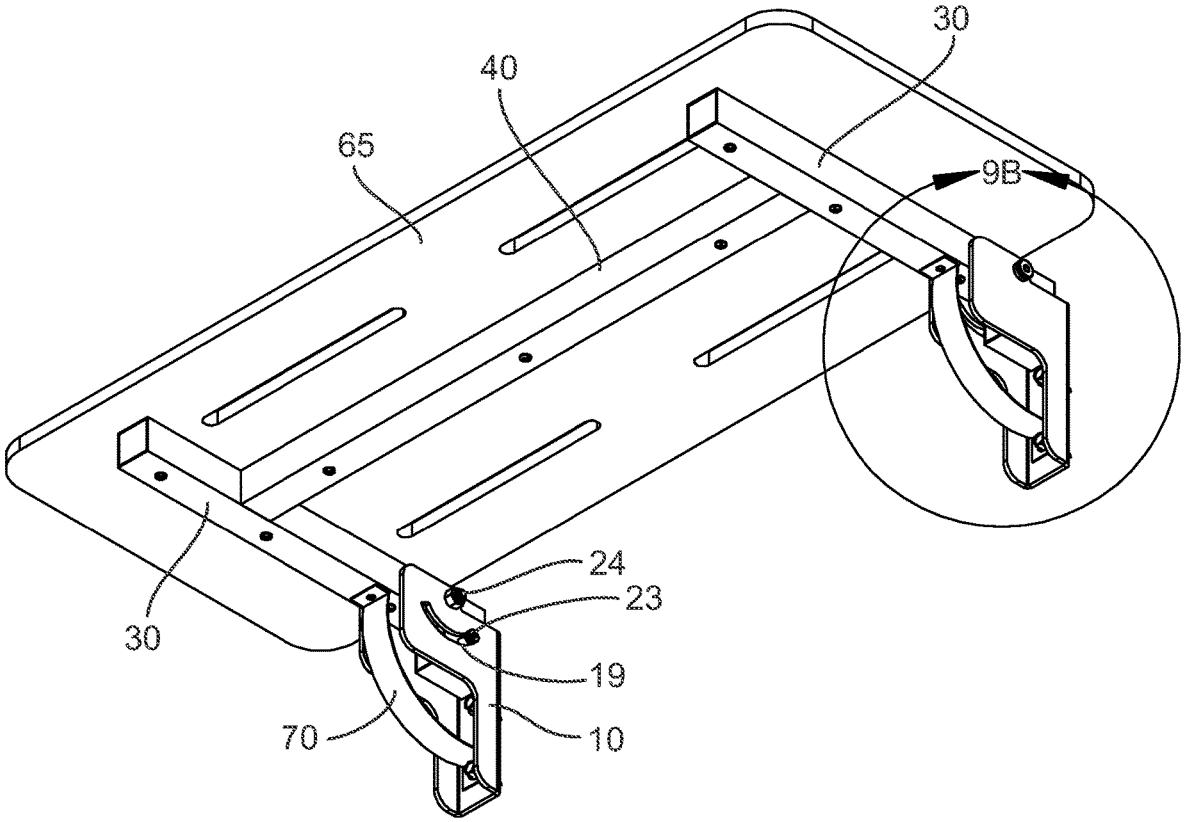
FIG. 9A is an underside perspective view of an embodiment of a shower seat assembly of the instant invention in a lowered position.
Figure 9B:
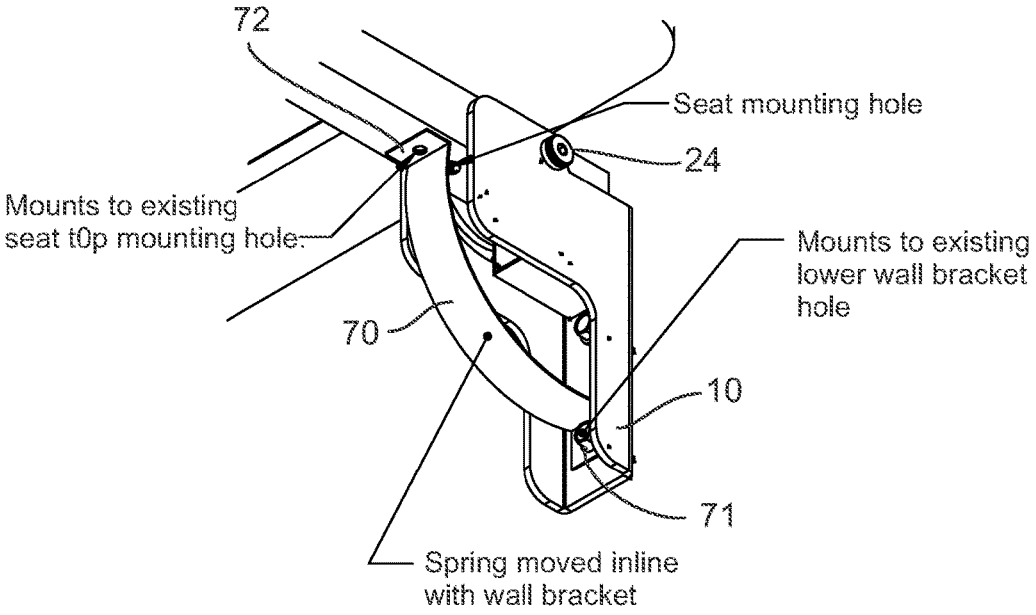
FIG. 9B is a zoomed in underside perspective view of an embodiment of a mounting bracket of the instant invention in a lowered position.

The present invention now will be described more fully hereinafter in the following detailed description of the invention, in which some, but not all embodiments of the invention are described. Indeed, this invention may be embodied in many different forms and should not be construed as limited to the embodiments set forth herein; rather, these embodiments are provided so that this disclosure will satisfy applicable legal requirements.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The instant invention includes a shower seat assembly 5 comprising a first mounting bracket 10A with a front side 12 and a back side 13, a second mounting bracket 10B with a front side 12 and a back side 13, a first support rod 30A hingedly connected to the first mounting bracket 10A, a first tube stop 50A secured to the first support rod 30A, a second support rod hingedly connected to the second mounting bracket 10B, a second tube stop 50B secured to the second support rod 30B, a first spring 70A operationally associated with the first mounting bracket 10A and the first support rod 30A, a second spring 70B operationally associated with the second mounting bracket 10B and the second support rod 30B, and a seat 65 with an upper surface 66 and a lower surface 67, secured by its lower surface 67 to the first support rod 30A and the second support rod 30B, wherein the back side 13 of the first mounting bracket 10A and the second mounting bracket 10B are each engaged to a vertical or near vertical surface, wherein the first spring 70A and second spring 70B act to maintain the seat 65 in a vertical 77 or near vertical position when the seat 65 is not in use, and wherein the first spring 70A and second spring 70B are bent and deformed when the seat 65 is moved from the vertical 77 or near vertical position to a horizontal 78 or near horizontal position during use.

Looking to FIGS. 1-7, a shower seat assembly 5 is illustrated which includes a first mounting bracket 10A with a front side 12 and a back side 13, a first bracket mounting piece secured to the first mounting bracket 10A, a second mounting bracket 10B with a front side 12 and a back side 13, and a second bracket mounting piece 60B secured to the second mounting bracket 10B. A first support rod 30A is hingedly connected to the first mounting bracket 10A, a first tube stop 50A is secured to the first support rod 30A, and a first support rod mounting piece 62A is secured to the first support rod 30A. A second support rod 30B is hingedly connected to the second mounting bracket 10B, a second tube stop 50B is secured to the second support rod 30B, and a second support rod mounting piece 62B secured to the second support rod 50B. A first spring 70A is secured at a first end 71 to the first bracket mounting piece 60A, secured at an opposite end 72 to the first support rod mounting piece 62A, and operationally associated with the first mounting bracket 10A and the first support rod 30A. A second spring 70B is secured at a first end 71 to the second bracket mounting piece 60B, secured at an opposite end 72 to the second support rod mounting pieced 62B, and operationally associated with the second mounting bracket 10B and the second support rod A seat 65 with an upper surface 66 and a lower surface 67 is secured by its lower surface 66 to the first support rod 30A and the second support rod 30B, wherein the back side 13 of the first mounting bracket 10A and the backside 13 of the second mounting bracket 10B are each engaged to a vertical or near vertical surface, wherein the first spring 70A and second spring act to maintain the seat in a vertical 77 or near vertical position when the seat 65 is not in use, and wherein the first spring 70A and second spring 70B are bent and deformed when the seat is moved from the vertical 77 or near vertical position to a horizontal 78 or near horizontal position during use. Each bracket mounting piece 60A, 60B can include a mounting hole 61 to aid in securing one end of a spring 70 to the bracket mounting piece. Each support rod mounting piece 62A, 62B can include a mounting hole 63 to aid in securing one end of a spring to the support rod mounting piece.

Looking to FIGS. 8-9 and 11-13, a shower seat assembly 5 is illustrated which includes a first mounting bracket 10A with a front side 12 and a back side 13 and a second mounting bracket 10B with a front side 12 and a back side 13. There is a first support rod 30A hingedly connected to the first mounting bracket 10A and a first tube stop 50A secured to the first support rod 30A. There is a second support rod 30B hingedly connected to the second mounting bracket and a second tube stop 50B secured to the second support rod 30B. A first spring 70A is operationally associated with the first mounting bracket 10A and the first support rod 30A and a second spring 70B is operationally associated with the second mounting bracket 10B and the second support rod 30B. A seat 65 with an upper surface 66 and a lower surface 67 is secured by its lower surface 66 to the first support rod 30A and the second support rod 30B, wherein the back side 13 of the first mounting bracket 10A and the backside 13 of the second mounting bracket 10B are each engaged to a vertical or near vertical surface, wherein the first spring 70A and second spring 70B act to maintain the seat 65 in a vertical 77 or near vertical position when the seat is not in use, and wherein the first spring 70A and second spring 70B are bent and deformed when the seat 65 is moved from the vertical 77 or near vertical position to a horizontal 78 or near horizontal position during use. The elements in this embodiment include all of the features previously discussed and can include any feature discussed within this specification.

A shower seat assembly 5 of the instant invention comprises a first mounting bracket with a front side 12 and a back side 13, a second mounting bracket 10B with a front side 12 and a back side 13, a first support rod 30A hingedly connected to the first mounting bracket a first tube stop 50A secured to the first support rod 30A, a second support rod 30B hingedly connected to the second mounting bracket 10B, and a second tube stop 50B secured to the second support rod 30B. A first spring 70A with a first end 71 and a second end 72, wherein the first end 71 is secured to the front side 12 of the first mounting bracket 10A and the second end 72 is secured to the first support rod 30A, and wherein the first spring 70A is operationally associated with the first mounting bracket 10A and the first support rod 30A. A second spring 70B with a first end 71 and a second end 72, wherein the first end 71 is secured to the front side 12 of the second mounting bracket 10B and the second end 72 is secured to the second support rod 30B, and wherein the second spring 70B is operationally associated with the second mounting bracket 10B and the second support rod 30B. A seat 65 with an upper surface 66 and a lower surface 67 is secured by its lower 66 surface to the first support rod 30A and the second support rod 30B, wherein the back side 13 of the first mounting bracket 10A and the backside 13 of the second mounting bracket 10B are each engaged to a vertical or near vertical surface, wherein the first spring 70A and second spring 70B act to maintain the seat 65 in a vertical 77 or near vertical position when the seat 65 is not in use, and wherein the first spring 70A and second spring 70B are bent and deformed when the seat 65 is moved from the vertical 77 or near vertical position to a horizontal 78 or near horizontal position during use.

A shower seat assembly 5 of the instant invention includes a pair of mounting brackets (10A and 10B) which can be either identical to one another or mirror images of one another. Each mounting bracket 10 includes a center plate 11 with a front side 12 and a back side 13. An outer side support plate 17 is secured to one side of the center plate 11 and an inner side support plate 15 is secured to an opposite side of the center plate 11 wherein the outer side support plate 17 and the inner side support plate 15 form a U-shaped groove 22 within each mounting bracket 10. A through-hole 19 passes through the body 16 of the inner side support plate 15 and the body 18 of the outer side support plate 17. A hinge rod 24 passes through the through-hole 19 of the outer side support plate 17 of the first mounting bracket, through the support rod 30, and through the through-hole 19 of the inner side support plate 15 of the mounting bracket 10. An arcuate track groove 20 is located on the body 16 of the inner side support plate 15 wherein a guide rod 23 passes through the arcuate track groove 20 of the mounting bracket 10 and engages the tube stop 50. The mounting brackets 10 can be made from any material strong enough to be used to secure a seat to a vertical or near vertical surface including metal, plastic, wood, ceramic, carbon fiber, or a combination thereof.

The shower seat assembly 5 can further include connecting rod 40 secured at one end 43 to a first support rod 30A, secured at its opposite end 44 to a second support rod 30B, and secured to the lower surface 67 of the seat 65. The shower seat assembly can also be assembled so that the first tube stop 50A is secured to the first support rod 30A and the second tube stop 50B is secured to the second support rod 30B and each tube stop rotates with each rod as it moves from a vertical 77 position to a horizontal 78 position and engages with the front side 12 of each center plate 11 to stop the rotation and maintain the seat in the horizontal 78 position.

The support rod 30 illustrated in the various figures is generally fabricated from square tubing, but may be fabricated from other shapes of tubing (i.e., circular, rectangular, hexagonal, oval, etc.). Each support rod 30 includes a first end 33 which extends away from the mounting bracket 10 and a second end 34 which is engages to the mounting bracket 10. One or more mounting holes 35 can be included to aid in using one or more fasteners to secure the support rod 30 to a seat 65. A through-hole (not illustrated) can be included near the second end 34 of the support rod 30 to accommodate a hinge rod 24 which passes through a through-hole 19 on the outer support plate 17, through the through-hole of the support rod, and through a through-hole 19 on the inner support plate 15. Each shower seat assembly 5 includes a pair of support rods which are secured to the underside of the seat 65 and set parallel or about parallel to one another. The pair of support rods have a connecting rod secured between and to the support rods (see FIGS. 2, 4, 5, 7A, 8, 9, 12, and 13) to form a support panel.

The connecting rod 40 illustrated in the various figures is generally fabricated from square tubing, but may be fabricated from other shapes of tubing (i.e., circular, rectangular, hexagonal, oval, etc.). Each connecting rod 40 includes a first end 43 which engages with one support rod 30 and a second end 44 which is engages to a second support rod 30. One or more mounting holes 45 can be included to aid in using one or more fasteners to secure the connecting rod to a seat 65 and/or to the support rods.

The tube stop 50 illustrated in the various figures is generally fabricated from square tubing, but may be fabricated from other shapes of tubing (i.e., circular, rectangular, hexagonal, oval, etc.). Each tube stop 50 includes a first end 53 which extends away from the mounting bracket 10 and a second end 54 which is engages to the mounting bracket 10 when the seat is in a horizontal position. One or more mounting holes (not illustrated) can be included to aid in using one or more fasteners to secure the tube stop 50 to a support rod 30. A through-hole (not illustrated) can be included near the second end 54 of the tube stop 50 to accommodate a guide rod 23 which passes through an arcuate track groove 20 on the inner support plate 15, and through the through-hole of the tube stop to aid in guiding the seat 65 from the vertical position 77 to the horizontal position 78 or vice/versa. The support rods 30, connecting rods 40, and tube stops 50 can be made from any material strong enough to be used to withstand use as a component to a shower seat assembly including metal, plastic, wood, ceramic, carbon fiber, or a combination thereof. The materials can be solid, semi-solid, hollow, or any combination thereof.

Figure 10A:
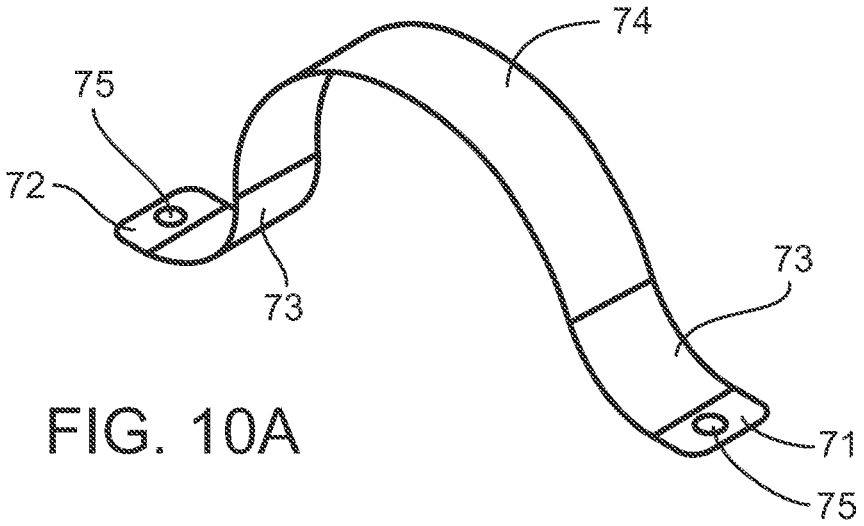
FIG. 10A is a perspective view of an embodiment of a spring in the instant invention.
Figure 10B:
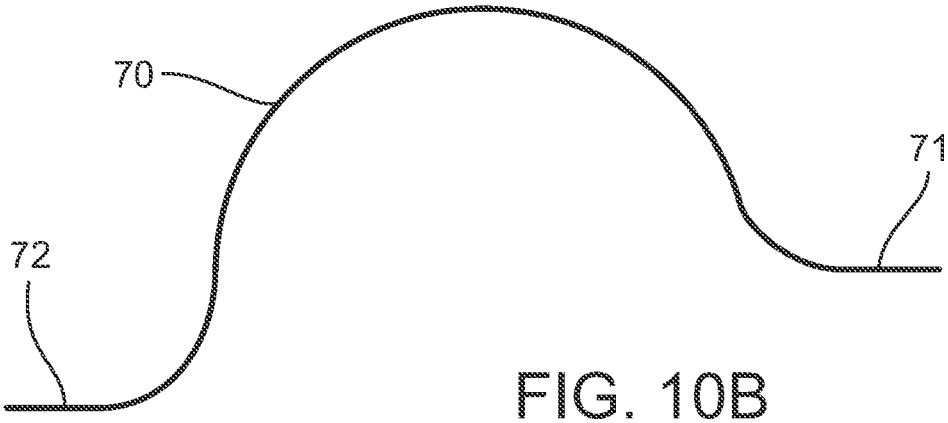
FIG. 10B is a side view of an embodiment of a spring in the instant invention.
Figure 10C:
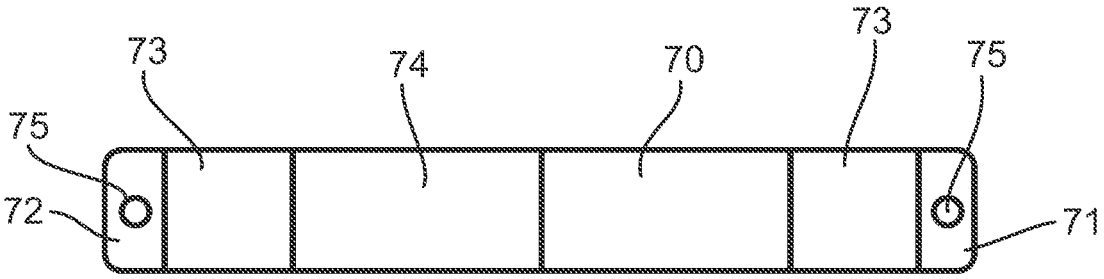
FIG. 10C is a top view of an embodiment of a spring in the instant invention.
Figure 11:
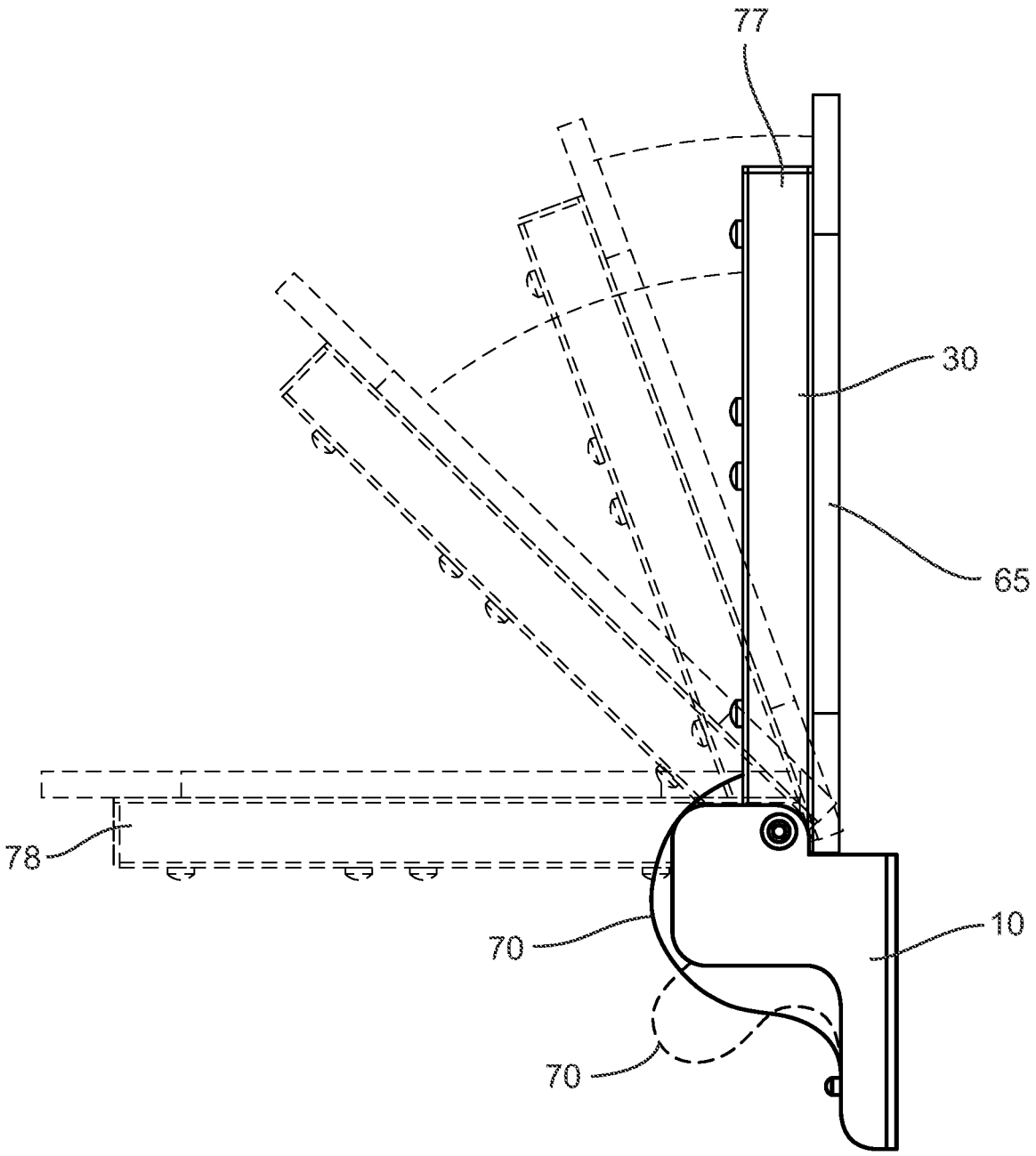
FIG. 11 is a side view of an embodiment a shower seat assembly of the instant invention transitioning from a lowered position to a raised position.
Figure 12:
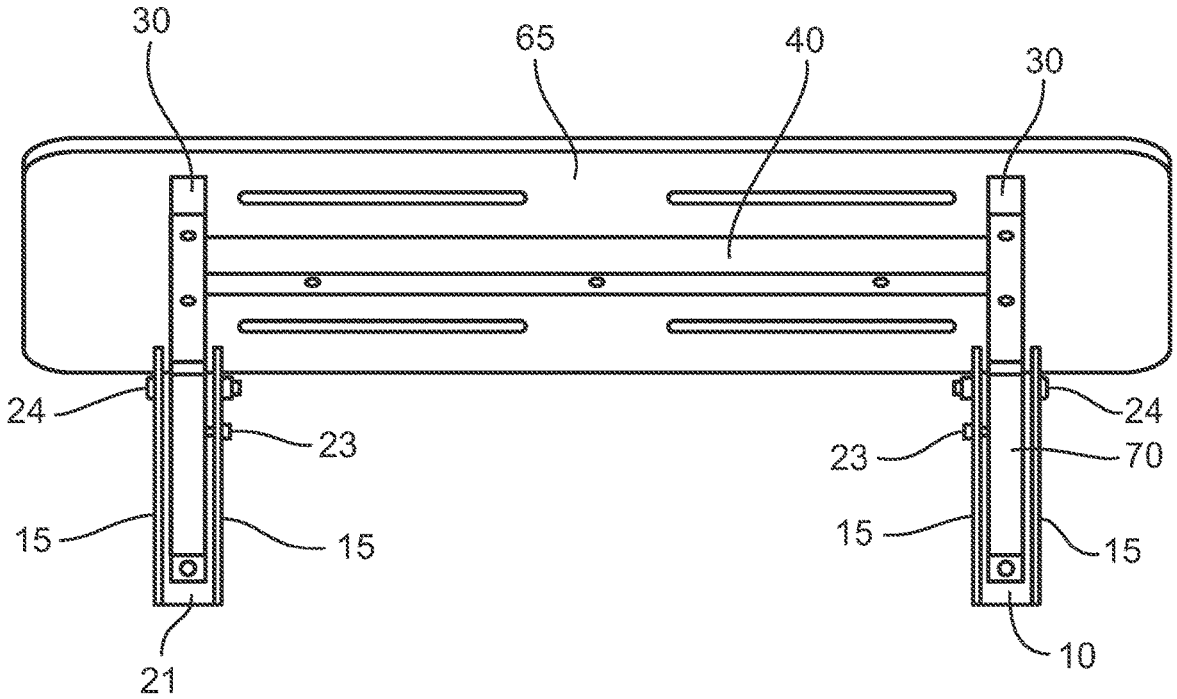
FIG. 12 is a front view of an embodiment a shower seat assembly of the instant invention in a partially lowered position.
Figure 13:
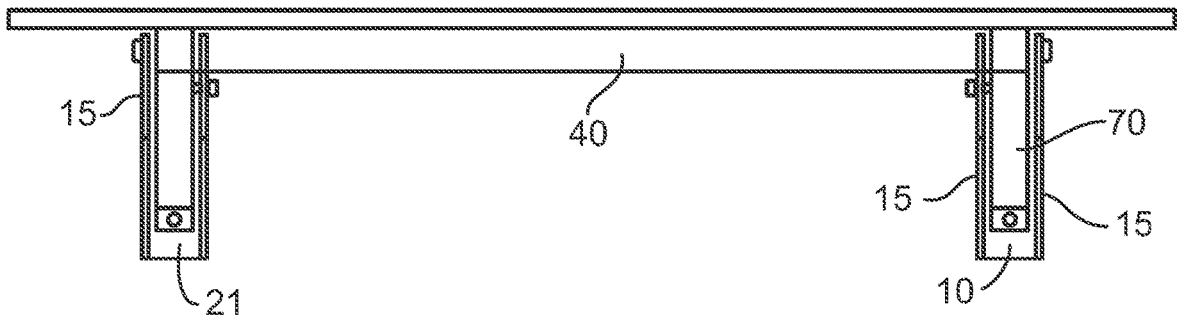
FIG. 13 is a front view of an embodiment a shower seat assembly of the instant invention in a lowered position.
Figure 14:
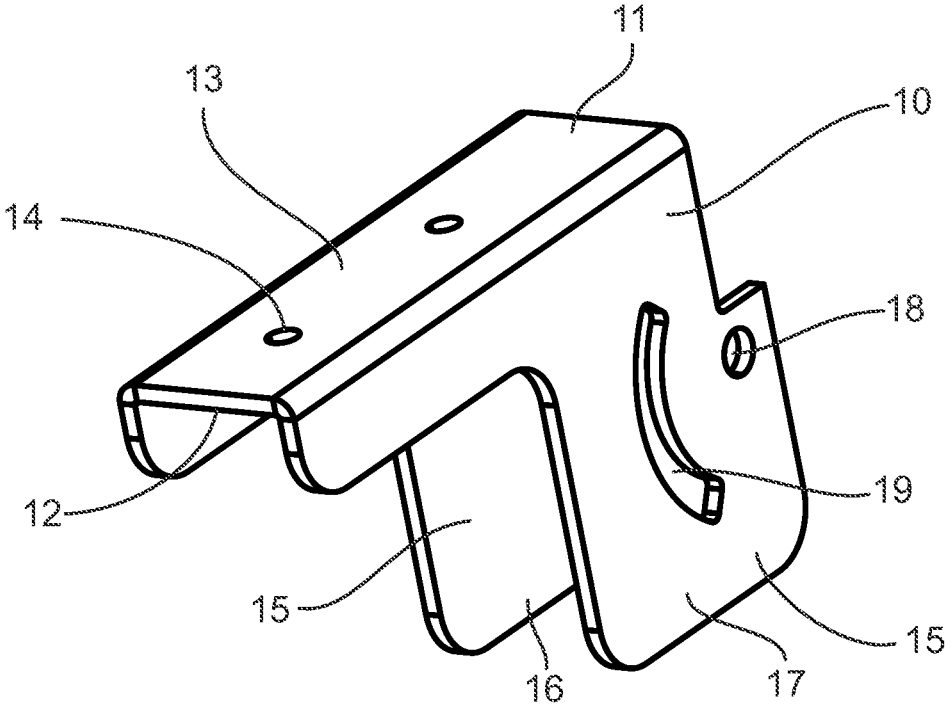
FIG. 14 is a perspective view of an embodiment of a mounting bracket of the instant invention.
Figure 15:
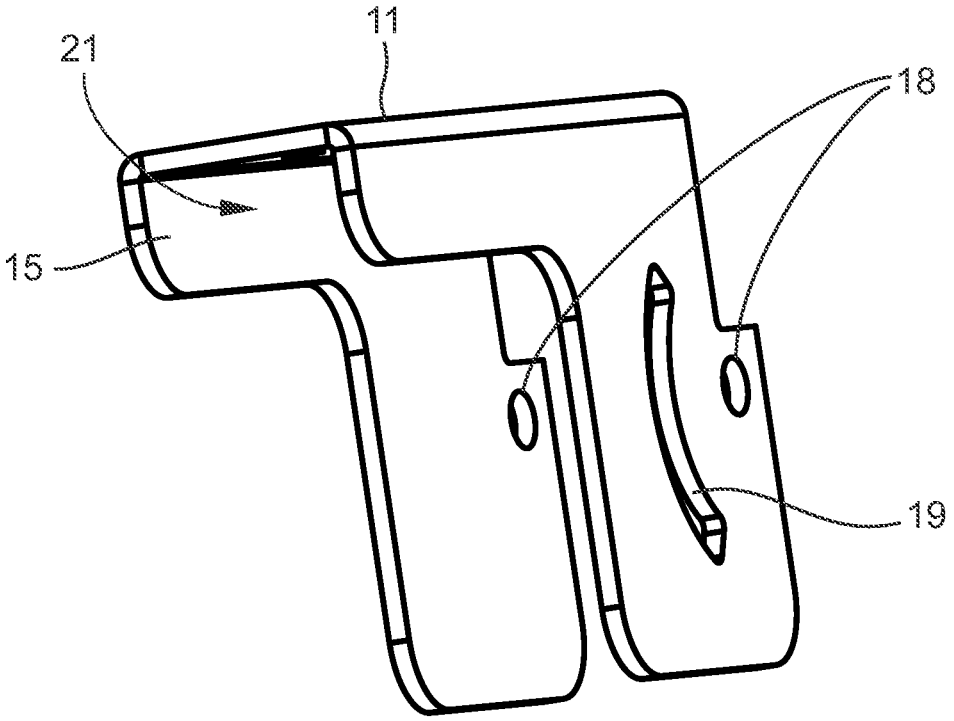
FIG. 15 is a perspective view of an embodiment of a mounting bracket of the instant invention.
Figure 16:
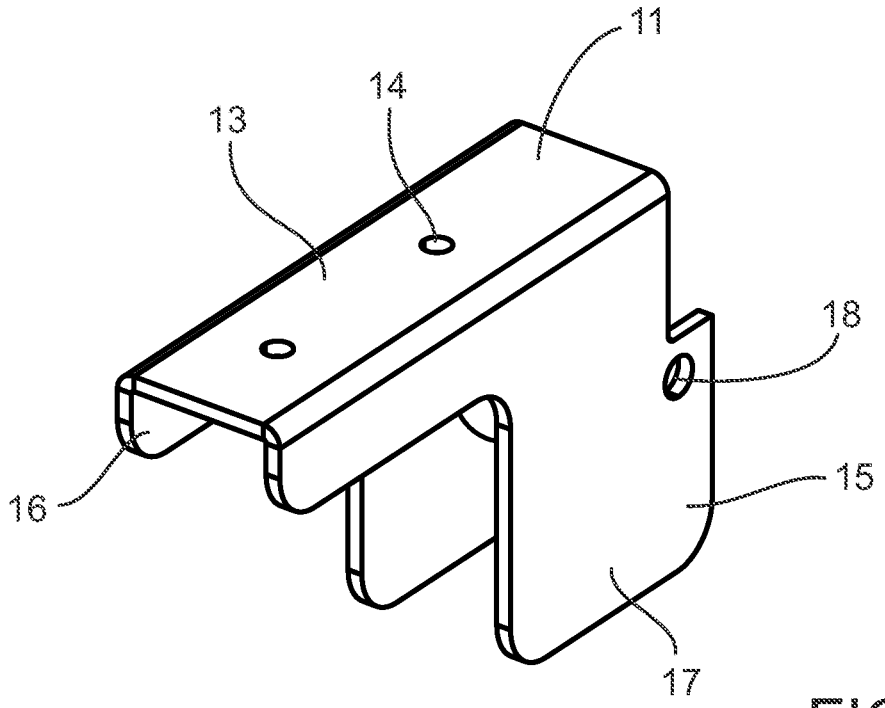
FIG. 16 is a perspective view of an embodiment of a mounting bracket of the instant invention.
Figure 17:
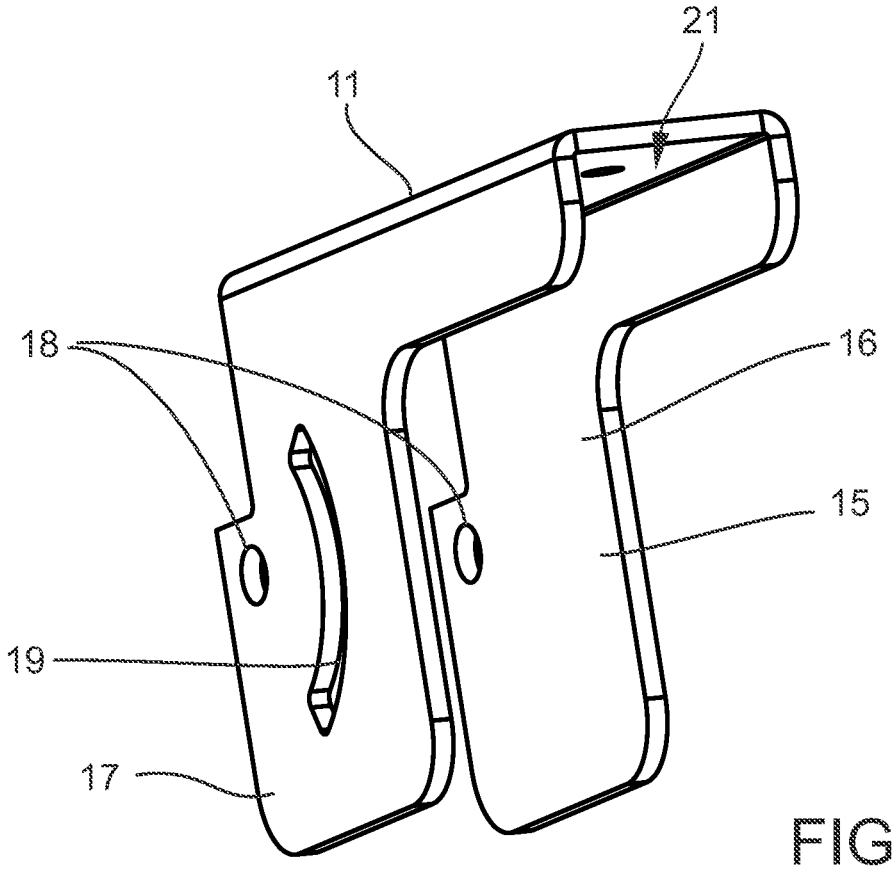
FIG. 17 is a perspective view of an embodiment of a mounting bracket of the instant invention.

The shower seat assembly includes springs 70 with a first end 71, a second end 72, a pair of bending sections 73, and a deformation section 74. Each spring 70 is generally made of metal, including alloys, but any material known in the art may be used to create the spring. Each spring is made of a flat material in a thin U-shaped structure (see FIGS. 10A-10C). Each spring can include a mounting hole 75 located at each end of the spring to assist with mounting the spring to the shower seat assembly. The bending sections 73 and deformation section 74 are arc-shaped structures which arc in opposite directions (FIGS. 10A and 10B). Each spring is deformed according to the angle of the support rod 30 and the mounting bracket 10 as the seat 65 is rotated from the vertical 77 or near vertical position to the horizontal 78 or near horizontal position. The elastic properties and memory of the spring 70 will apply an inverse force to each supporting rod 30 which exerts a downward push against the spring as the seat 65 is rotated to the horizontal position 78. When in use, each spring 70 will exert upward, rebound force to each supporting rod 30 and seat 65 in order to slow the rotation of the seat 65 as it is moved from the vertical position 77 to the horizontal position 78. When an individual has completed use of the seat 65, the rebound force of the spring 70 is sufficient to raise the seat automatically from the horizontal position 78 to the vertical position 77. The springs 70 are adjustable to either increase or decrease the bias of the spring relative to the seat 65. The thickness of the spring can range from 0.3 mm to 1.0 mm, 0.4 mm to 0.7 mm, 0.4 mm to 0.6 mm. The thickness of the spring can be 0.5 mm, less than 0.5 mm, or greater than 0.5 mm. The radius of the deformation section 74 of a spring can range from 20-100 mm, 25-90 mm, 30-80 mm, or The radius of each bending section can range from 5-65 mm, 10-50 mm, 15-45 mm, or In one embodiment, the radius of the deformation section 74 of a spring is about and the radius of each bending section is about 25 mm.

The shower seat assembly 5 includes a seat 65 having an upper surface 66, a lower surface 67, a body 69, and one or more drainage holes 68. The seat 65 can be made from any material strong enough to be used to withstand use as a component to a shower seat assembly including metal, plastic, wood, ceramic, carbon fiber, or a combination thereof. The materials can be solid, semi-solid, hollow, or any combination thereof.

As illustrated in the figures, a variety of fasteners 25 are used to secure the various components of the invention to one another. The fasteners can be any fastener known in the art and include, but are not limited to, rivets, screws, bolts, adhesives, and welds. The fasteners can be used in conjunction with any type of washer 26 or nut 27.

1. A shower seat assembly comprising:
   a first mounting bracket with a front side and a back side;
   a second mounting bracket with a front side and a back side;
   a first support rod hingedly connected to the first mounting bracket;
   a first tube stop secured to the first support rod;
   a second support rod hingedly connected to the second mounting bracket;
   a second tube stop secured to the second support rod;
   a first spring operationally associated with the first mounting bracket and the first support rod;
   a second spring operationally associated with the second mounting bracket and the second support rod; and
   a seat with an upper surface and a lower surface secured by its lower surface to the first support rod and the second support rod;
   wherein the back side of the first mounting bracket and the backside of the second mounting bracket are each engaged to a vertical or near vertical surface;
   wherein the first spring and second spring act to maintain the seat in a vertical or near vertical position when the seat is not in use; and
   wherein the first spring and second spring are bent and deformed when the seat is moved from the vertical or near vertical position to a horizontal or near horizontal position during use.
2. The shower seat assembly of claim 1 wherein the first spring and the second spring are U-shaped.
3. The shower seat assembly of claim 1 wherein the first mounting bracket and the second mounting bracket are comprised of metal.
4. The shower seat assembly of claim 1 further comprising a connecting rod secured at one end to the first support rod, secured at its opposite end to the second support rod, and secured to the lower surface of the seat.
5. The shower seat assembly of claim 1 wherein the first mounting bracket and the second mounting bracket are each comprised of:
   a center plate with a front side and a back side;
   an outer side support plate secured to one side of the center plate;
   an inner side support plate secured to an opposite side of the center plate;
   wherein the outer side support plate and the inner side support plate form a U-shaped groove within each mounting bracket;
   a through-hole passing through a body of the inner side support plate and a body of the outer side support plate;
   wherein a first hinge rod passes through the through-hole of the outer side support plate of the first mounting bracket, through the first support rod, and through the through-hole of the inner side support plate of the first mounting bracket;
   wherein a second hinge rod passes through the through-hole of the outer side support plate of the second mounting bracket, through the second support rod, and through the through-hole of the inner side support plate of the second mounting bracket;
   an arcuate track groove located on the body of the inner side support plate;
   wherein a first guide rod passes through the arcuate track groove of the first mounting bracket and engages the first tube stop; and
   wherein a second guide rod passes through the arcuate track groove of the second mounting bracket and engages the second tube stop.
6. The shower seat assembly of claim 5 wherein the first tube stop is secured to the first support rod and the second tube stop is secured to the second support rod and each tube stop rotates with each rod as it moves from a raised position to a lowered position and engages with the front side of each center plate to stop the rotation and maintain the lowered position.
7. A shower seat assembly comprising:
   a first mounting bracket with a front side and a back side;
   a first bracket mounting piece secured to the first mounting bracket;
   a second mounting bracket with a front side and a back side;
   a second bracket mounting piece secured to the second mounting bracket;
   a first support rod hingedly connected to the first mounting bracket;
   a first tube stop secured to the first support rod;
   a first support rod mounting piece secured to the first support rod;
   a second support rod hingedly connected to the second mounting bracket;
   a second tube stop secured to the second support rod;
   a second support rod mounting piece secured to the second support rod;
   a first spring secured at a first end to the first bracket mounting piece, secured at an opposite end to the first support rod mounting piece, and operationally associated with the first mounting bracket and the first support rod;
   a second spring secured at a first end to the second bracket mounting piece, secured at an opposite end to the second support rod mounting pieced, and operationally associated with the second mounting bracket and the second support rod; and
   a seat with an upper surface and a lower surface secured by its lower surface to the first support rod and the second support rod;
   wherein the back side of the first mounting bracket and the backside of the second mounting bracket are each engaged to a vertical or near vertical surface;

wherein the first spring and second spring act to maintain the seat in a vertical or near vertical position when the seat is not in use; and wherein the first spring and second spring are bent and deformed when the seat is moved from the vertical or near vertical position to a horizontal or near horizontal position during use.

8. The shower seat assembly of claim 7 wherein the first spring and the second spring are U-shaped.

9. The shower seat assembly of claim 7 wherein the first mounting bracket and the second mounting bracket are comprised of metal.

10. The shower seat assembly of claim 7 further comprising a connecting rod secured at one end to the first support rod, secured at its opposite end to the second support rod, and secured to the lower surface of the seat.

11. The shower seat assembly of claim 7 wherein the first mounting bracket and the second mounting bracket are each comprised of:

a center plate with a front side and a back side;

an outer side support plate secured to one side of the center plate;

an inner side support plate secured to an opposite side of the center plate;

wherein the outer side support plate and the inner side support plate form a U-shaped groove within each mounting bracket;

a through-hole passing through a body of the inner side support plate and a body of the outer side support plate;

wherein a first hinge rod passes through the through-hole of the outer side support plate of the first mounting bracket, through the first support rod, and through the through-hole of the inner side support plate of the first mounting bracket;

wherein a second hinge rod passes through the through-hole of the outer side support plate of the second mounting bracket, through the second support rod, and through the through-hole of the inner side support plate of the second mounting bracket;

an arcuate track groove located on the body of the inner side support plate;

wherein a first guide rod passes through the arcuate track groove of the first mounting bracket and engages the first tube stop; and wherein a second guide rod passes through the arcuate track groove of the second mounting bracket and engages the second tube stop.

12. The shower seat assembly of claim 11 wherein the first tube stop is secured to the first support rod and the second tube stop is secured to the second support rod and each tube stop rotates with each rod as it moves from a raised position to a lowered position and engages with the front side of each center plate to stop the rotation and maintain the lowered position.

13. A shower seat assembly comprising:

a first mounting bracket with a front side and a back side;

a second mounting bracket with a front side and a back side;

a first support rod hingedly connected to the first mounting bracket;

a first tube stop secured to the first support rod;

a second support rod hingedly connected to the second mounting bracket;

a second tube stop secured to the second support rod;

a first spring with a first end and a second end;

wherein the first end is secured to the front side of the first mounting bracket and the second end is secured to the first support rod;

wherein the first spring is operationally associated with the first mounting bracket and the first support rod;

a second spring with a first end and a second end;

wherein the first end is secured to the front side of the second mounting bracket and the second end is secured to the second support rod;

wherein the second spring is operationally associated with the second mounting bracket and the second support rod; and a seat with an upper surface and a lower surface secured by its lower surface to the first support rod and the second support rod;

wherein the back side of the first mounting bracket and the backside of the second mounting bracket are each engaged to a vertical or near vertical surface;

wherein the first spring and second spring act to maintain the seat in a vertical or near vertical position when the seat is not in use; and wherein the first spring and second spring are bent and deformed when the seat is moved from the vertical or near vertical position to a horizontal or near horizontal position during use.

14. The shower seat assembly of claim 13 wherein the first spring and the second spring are U-shaped.

15. The shower seat assembly of claim 13 wherein the first mounting bracket and the second mounting bracket are comprised of metal.

16. The shower seat assembly of claim 13 further comprising a connecting rod secured at one end to the first support rod, secured at its opposite end to the second support rod, and secured to the lower surface of the seat.

17. The shower seat assembly of claim 13 wherein the first mounting bracket and the second mounting bracket are each comprised of:

a center plate with a front side and a back side;

an outer side support plate secured to one side of the center plate;

an inner side support plate secured to an opposite side of the center plate;

wherein the outer side support plate and the inner side support plate form a U-shaped groove within each mounting bracket;

a through-hole passing through a body of the inner side support plate and a body of the outer side support plate;

wherein a first hinge rod passes through the through-hole of the outer side support plate of the first mounting bracket, through the first support rod, and through the through-hole of the inner side support plate of the first mounting bracket;

wherein a second hinge rod passes through the through-hole of the outer side support plate of the second mounting bracket, through the second support rod, and through the through-hole of the inner side support plate of the second mounting bracket;

an arcuate track groove located on the body of the inner side support plate;

wherein a first guide rod passes through the arcuate track groove of the first mounting bracket and engages the first tube stop; and wherein a second guide rod passes through the arcuate track groove of the second mounting bracket and engages the second tube stop.

18. The shower seat assembly of claim 17 wherein the first tube stop is secured to the first support rod and the second tube stop is secured to the second support rod and each tube stop rotates with each rod as it moves from a raised position to a lowered position and engages with the front side of each center plate to stop the rotation and maintain the lowered position.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present invention may be embodied in other forms without departing from the spirit and the essential attributes thereof, and, accordingly, reference should be made to the appended claims, rather than to the foregoing specification, as indicating the scope of the invention. The invention illustratively disclosed herein suitably may be practiced in the absence of any element which is not specifically disclosed herein.

The invention claimed is:

1. A shower seat assembly comprising:

a first mounting bracket with a front side and a back side;

a second mounting bracket with a front side and a back side;

a first support rod connected to the first mounting bracket;

a second support rod connected to the second mounting bracket;

a first spring operationally associated with the first mounting bracket and the first support rod;

a second spring operationally associated with the second mounting bracket and the second support rod;

wherein the first spring and the second spring are U-shaped; and a seat with an upper surface and a lower surface secured by its lower surface to the first support rod and the second support rod;

wherein the first spring and second spring act to maintain the seat in a vertical or near vertical position when the seat is not in use.

2. The shower seat assembly of claim 1 wherein the first mounting bracket and the second mounting bracket are comprised of metal.

3. The shower seat assembly of claim 1 further comprising a connecting rod secured at one end to the first support rod, secured at its opposite end to the second support rod, and secured to the lower surface of the seat.

4. The shower seat assembly of claim 1 wherein the first mounting bracket and the second mounting bracket are each comprised of:

a center plate with a front side and a back side;

an outer side support plate secured to one side of the center plate;

an inner side support plate secured to an opposite side of the center plate;

wherein the outer side support plate and the inner side support plate form a U-shaped groove within each mounting bracket;

a through-hole passing through a body of the inner side support plate and a body of the outer side support plate;

wherein a first hinge rod passes through the through-hole of the outer side support plate of the first mounting bracket, through the first support rod, and through the through-hole of the inner side support plate of the first mounting bracket;

wherein a second hinge rod passes through the through-hole of the outer side support plate of the second mounting bracket, through the second support rod, and through the through-hole of the inner side support plate of the second mounting bracket;

an arcuate track groove located on the body of the inner side support plate;

wherein a first guide rod passes through the arcuate track groove of the first mounting bracket and engages the first tube stop; and wherein a second guide rod passes through the arcuate track groove of the second mounting bracket and engages the second tube stop.

5. The shower seat assembly of claim 4 wherein a first tube stop is secured to the first support rod and a second tube stop is secured to the second support rod and each tube stop rotates with each rod as it moves from a raised position to a lowered position and engages with the front side of each center plate to stop the rotation and maintain the lowered position.

6. A shower seat assembly comprising:

a first mounting bracket with a front side and a back side;

a first bracket mounting piece secured to the first mounting bracket;

a second mounting bracket with a front side and a back side;

a second bracket mounting piece secured to the second mounting bracket;

a first support rod connected to the first mounting bracket;

a first support rod mounting piece secured to the first support rod;

a second support rod connected to the second mounting bracket;

a second support rod mounting piece secured to the second support rod;

a first spring operationally associated with the first bracket mounting piece, the first mounting bracket, and the first support rod a second spring operationally associated with the second bracket mounting piece, the second mounting bracket, and the second support rod; and a seat with an upper surface and a lower surface secured by its lower surface to the first support rod and the second support rod;

wherein the first spring and second spring act to maintain the seat in a vertical or near vertical position when the seat is not in use.

7. The shower seat assembly of claim 6 wherein the first spring and the second spring are U-shaped.

8. The shower seat assembly of claim 6 wherein the first mounting bracket and the second mounting bracket are comprised of metal.

9. The shower seat assembly of claim 6 further comprising a connecting rod secured at one end to the first support rod, secured at its opposite end to the second support rod, and secured to the lower surface of the seat.

10. The shower seat assembly of claim 6 wherein the first mounting bracket and the second mounting bracket are each comprised of:

a center plate with a front side and a back side;

an outer side support plate secured to one side of the center plate;

an inner side support plate secured to an opposite side of the center plate;

wherein the outer side support plate and the inner side support plate form a U-shaped groove within each mounting bracket;

a through-hole passing through a body of the inner side support plate and a body of the outer side support plate;

wherein a first hinge rod passes through the through-hole of the outer side support plate of the first mounting bracket, through the first support rod, and through the through-hole of the inner side support plate of the first mounting bracket;

wherein a second hinge rod passes through the through-hole of the outer side support plate of the second mounting bracket, through the second support rod, and through the through-hole of the inner side support plate of the second mounting bracket;

an arcuate track groove located on the body of the inner side support plate;

wherein a first guide rod passes through the arcuate track groove of the first mounting bracket and engages the first tube stop; and wherein a second guide rod passes through the arcuate track groove of the second mounting bracket and engages the second tube stop.

11. The shower seat assembly of claim 10 wherein a first tube stop is secured to the first support rod and a second tube stop is secured to the second support rod and each tube stop rotates with each rod as it moves from a raised position to a lowered position and engages with the front side of each center plate to stop the rotation and maintain the lowered position.

12. A shower seat assembly comprising:

a first mounting bracket with a front side and a back side;

a second mounting bracket with a front side and a back side;

a first support rod connected to the first mounting bracket;

a second support rod connected to the second mounting bracket;

a first spring with a first end and a second end;

wherein the first spring is U-shaped;

wherein the first end is secured to the front side of the first mounting bracket and the second end is secured to the first support rod;

wherein the first spring is operationally associated with the first mounting bracket and the first support rod;

a second spring with a first end and a second end;

wherein the second spring is U-shaped;

wherein the first end is secured to the front side of the second mounting bracket and the second end is secured to the second support rod;

wherein the second spring is operationally associated with the second mounting bracket and the second support rod; and a seat with an upper surface and a lower surface secured by its lower surface to the first support rod and the second support rod;

wherein the first spring and second spring act to maintain the seat in a vertical or near vertical position when the seat is not in use; and wherein the first spring and second spring are bent and deformed when the seat is moved from the vertical or near vertical position to a horizontal or near horizontal position during use.

13. The shower seat assembly of claim 12 wherein the first mounting bracket and the second mounting bracket are comprised of metal.

14. The shower seat assembly of claim 12 further comprising a connecting rod secured at one end to the first support rod, secured at its opposite end to the second support rod, and secured to the lower surface of the seat.

15. The shower seat assembly of claim 12 wherein the first mounting bracket and the second mounting bracket are each comprised of:

a center plate with a front side and a back side;

an outer side support plate secured to one side of the center plate;

an inner side support plate secured to an opposite side of the center plate;

wherein the outer side support plate and the inner side support plate form a U-shaped groove within each mounting bracket;

a through-hole passing through a body of the inner side support plate and a body of the outer side support plate;

wherein a first hinge rod passes through the through-hole of the outer side support plate of the first mounting bracket, through the first support rod, and through the through-hole of the inner side support plate of the first mounting bracket;

wherein a second hinge rod passes through the through-hole of the outer side support plate of the second mounting bracket, through the second support rod, and through the through-hole of the inner side support plate of the second mounting bracket;

an arcuate track groove located on the body of the inner side support plate;

wherein a first guide rod passes through the arcuate track groove of the first mounting bracket and engages the first tube stop; and wherein a second guide rod passes through the arcuate track groove of the second mounting bracket and engages the second tube stop.

16. The shower seat assembly of claim 15 wherein a first tube stop is secured to the first support rod and a second tube stop is secured to the second support rod and each tube stop rotates with each rod as it moves from a raised position to a lowered position and engages with the front side of each center plate to stop the rotation and maintain the lowered position.

* * * * *